US005315930A

United States Patent [19]

Niemiro

[11] Patent Number: 5,315,930

[45] Date of Patent: May 31, 1994

[54] KEYLESS INKING SYSTEM FOR A PRINTING PRESS

[75] Inventor: Thaddeus A. Niemiro, Lisle, Ill.

[73] Assignee: Rockwell International Corporation, El Segundo, Calif.

[21] Appl. No.: 983,029

[22] Filed: Nov. 30, 1992

Related U.S. Application Data

[63] Continuation of Ser. No. 800,945, Dec. 2, 1991, abandoned.

[51] Int. Cl.[5] ..... B41F 31/08; B41L 27/10

[52] U.S. Cl. ..... 101/366

[58] Field of Search ..... 101/350, 365, 366, 148, 101/351, 352, 349; 118/259, 258, 410, 413, DIG. 15

[56] References Cited

U.S. PATENT DOCUMENTS

| | | | |
|---|---|---|---|
| 2,898,618 | 8/1959 | Whitfield et al. | 118/259 X |
| 3,658,003 | 4/1972 | Johnson | 101/366 |
| 4,015,307 | 4/1977 | Kossack | 101/425 |
| 4,281,597 | 8/1981 | Dressler | 101/366 |
| 4,527,479 | 7/1985 | Dahlgren | 101/350 |
| 5,027,706 | 7/1991 | Niemiro et al. | 101/366 |
| 5,031,529 | 7/1991 | Greenwood | 101/366 |

*Primary Examiner*—J. Reed Fisher

*Attorney, Agent, or Firm*—C. B. Patti; H. F. Hamann

[57] ABSTRACT

An inking system (10) for a printing press (12) having an ink injector (18) for supplying ink under pressure and having a device (50) for pumping and metering the ink flow in the injector (18), a fountain roller (14) having an outer brush surface (26) in close contact with the ink injector (18), a device (29) for rotating the fountain roller (14), a pick up roll (16) located adjacent the fountain roller (14) to receive ink from the fountain roller (14), a device (29) for rotating the pick up roller (14), and a device (42) for scraping the residual ink from a scraper roller (40) receiving ink from a rubber covered roller.

3 Claims, 9 Drawing Sheets

KEYLESS INKING SYSTEM FOR A PRINTING PRESS

This is a continuation of application Ser. No. 800,945, filed Dec. 2, 1991, now abandoned.

BACKGROUND OF THE INVENTION

The present invention relates to an inking system for a printing press.

In the past, inking devices have been known for a printing press, such as an open fountain with a trough for supplying ink to a fountain roller for use in the press. In such devices, it has been necessary to use a plurality of keys to control the amount of ink passage depending upon the pattern of the image printed.

It has been necessary to adjust the ink, since when a desired thickness of ink is supplied to a printing plate by the last inking roller in contact with it, an equal amount of ink is returned to the ink train because the ink divides equally between any two outgoing surfaces. In the keyless process, this return ink is removed by a scraper blade leaving no residual image, and making the key adjustments unnecessary. The ink film thickness must be uniform across the inking rollers, and constant with the press speed changes.

SUMMARY OF THE INVENTION

A feature of the present invention is the provision of an improved inking system for a printing press.

The inking system of the present invention comprises, an ink injector for supplying ink under pressure and having means for pumping and metering the ink flow in the injector, a fountain roll having an outer brush surface in contact with an ink distribution manifold, means for controlling the rotation of the fountain roller, and pick up roller in contact with the fountain roller brush to receive ink from the fountain roller, with the pick up roller being driven by a press gear train.

A feature of the present invention is the provision of means for scraping the residual ink from a scraper roller receiving ink from a rubber covered roller.

Thus, another feature of the invention is that the scraped ink removes a residual image which may be formed on the roll.

Another feature of the invention is that the scraped ink may be circulated with new ink to the ink injector for subsequent use on the printing press.

A further feature of the invention is that the amount of ink passage is controlled to be generally proportional to the speed of the press.

Still another feature of the invention is that the scraper roller surface may be constructed from a durable ink receptive ceramic material, from copper, or some other such material.

Yet another feature of the invention is that the pumping means generates a plurality of ink streams for passage to the ink distribution manifold, and then to the fountain roller in order to provide an improved and uniform distribution of ink.

Another feature of the invention is that the pumping and metering means may comprise a plurality of stream gear pumps for pumping the ink in the ink injector in proportion to the speed of the press.

Thus, a feature of the invention is that the ink is pumped under positive pressure in the ink injector for distribution on the brush fountain roller.

Yet another feature of the invention is that the inking system minimizes the formation of ink shadows or starvation zones on the inking rollers and consequently on the printed paper.

Another feature of the invention is that the proportionality of the pumped ink to the press speed may be changed, allowing change of printed ink density.

A further feature of the invention is that the ink is supplied by the brush of the fountain roller to the pick up roller without the necessity of carefully setting a gap between the fountain roller and pick up roller.

Yet another feature of the invention is that the inking device provides for an improved ink uniformity and smooth lay down of the ink in the ink train by means of the ink distribution header and a smoothing blade against the brush.

Still another feature of the invention is that the ink is supplied continuously to the fountain roller by the inking system of the present invention.

Another feature of the invention is that the fountain brush roller helps to evenly distribute entrapped water in the ink, and promotes evaporation of the water.

A further feature of the invention is that the inking system provides an improved shade control through modulation of the ink drive.

A further feature of the invention is that page wide modules of the inking system may be interchanged.

Thus, a feature of the present invention is that the modules of the inking system may be easily changed when different colors-are needed for the press.

Yet another feature of the invention is that fewer geometrical restrictions are placed on the inking system since the pumps are not gravity dependent and no reversing rollers are required for reversing couples.

Thus, another feature of the invention is that the pick up roller can turn in either direction in relation to the fountain roller brush.

Further features will become more fully apparent in the following description of the embodiments of this invention, and from the appended claims.

DESCRIPTION OF THE PREFERRED EMBODIMENTS

Figure 1:
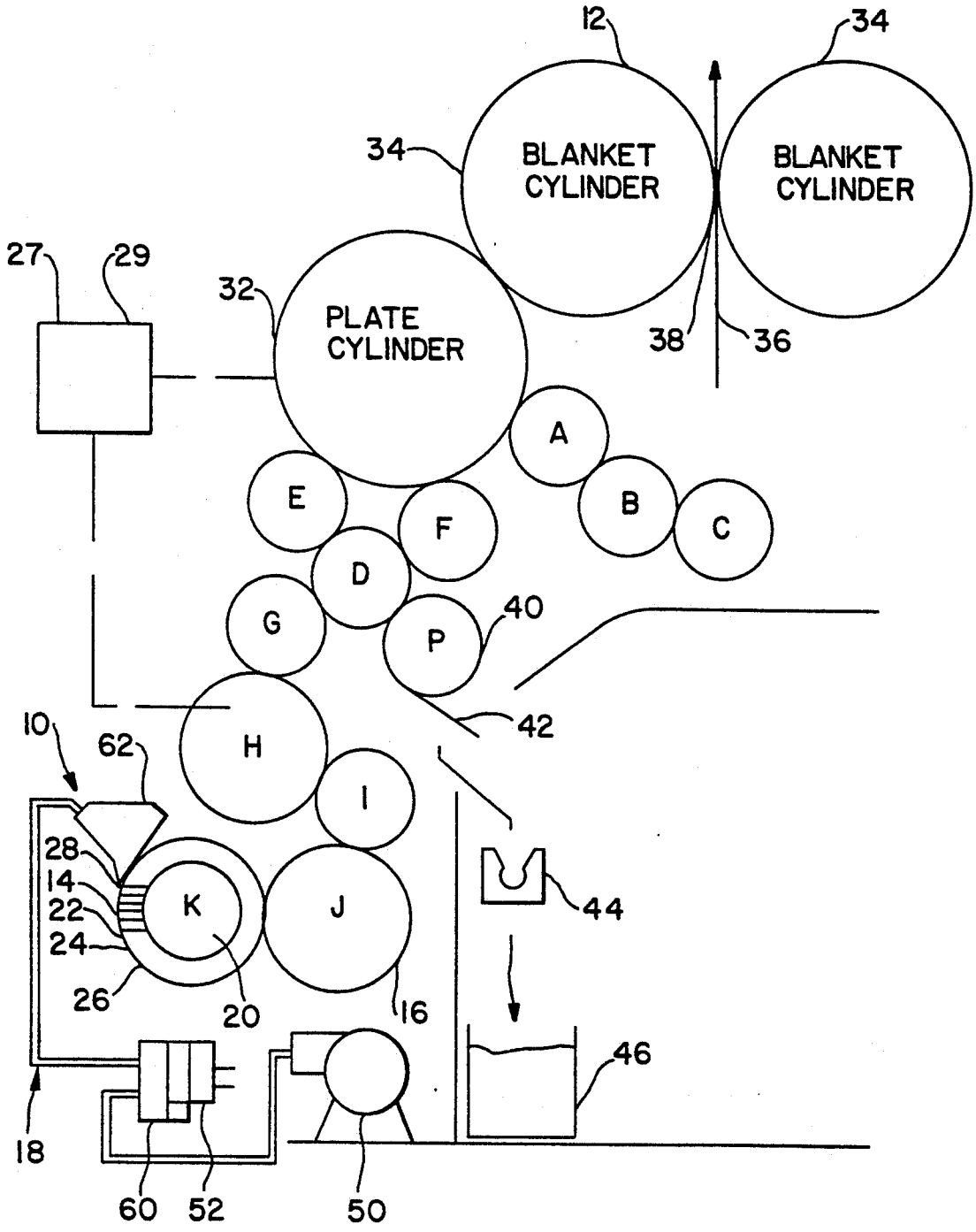
FIG. 1 is a diagrammatic view of an inking system for a printing press of the present invention.
Figure 2:
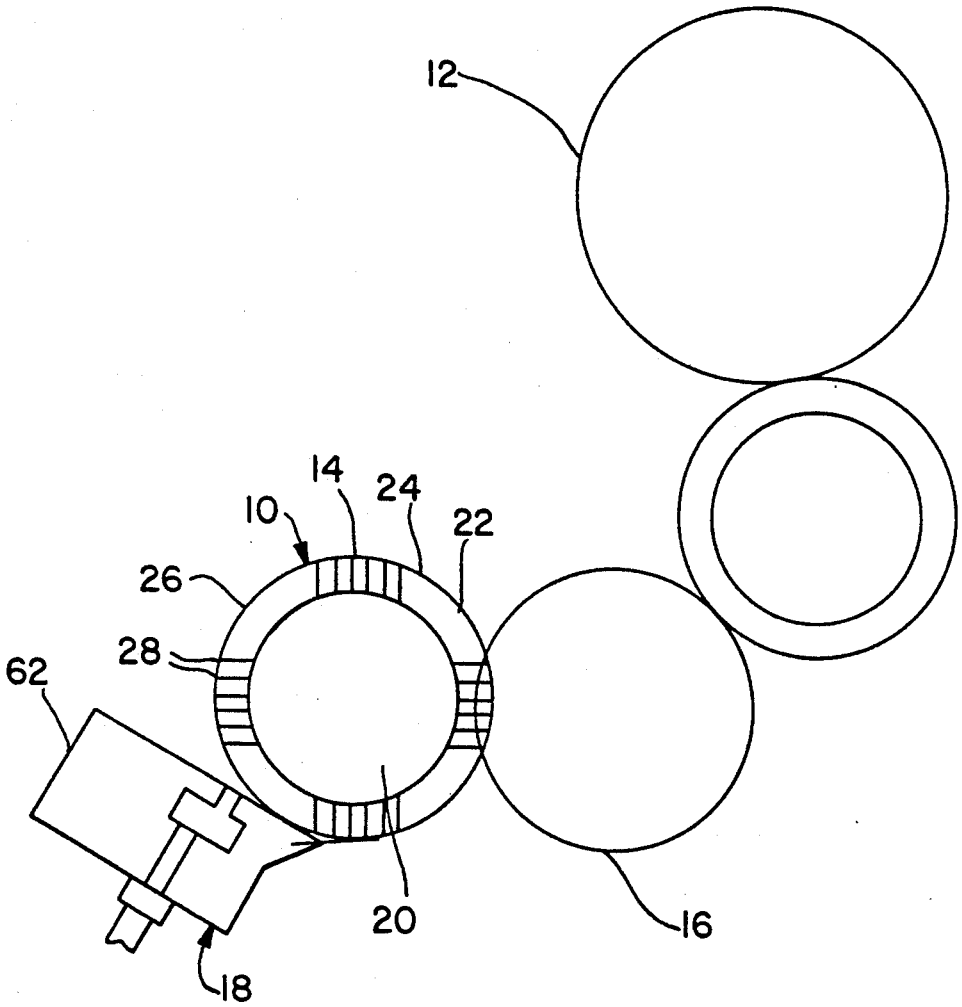
FIG. 2 is a fragmentary diagrammatic view of the inking system of FIG. 1 on an enlarged scale.

Referring now to FIGS. 1 and 2, there is shown an inking system generally designated 10 for a printing press 12. As shown, the press 12 has a plurality of rolls or rollers A, B, C, D, E, F, G, H, and I, a scraper roller 40, a fountain roller 14, and a pick up roller 16. The inking system also has an ink injector generally designating 18.

Figure 3:
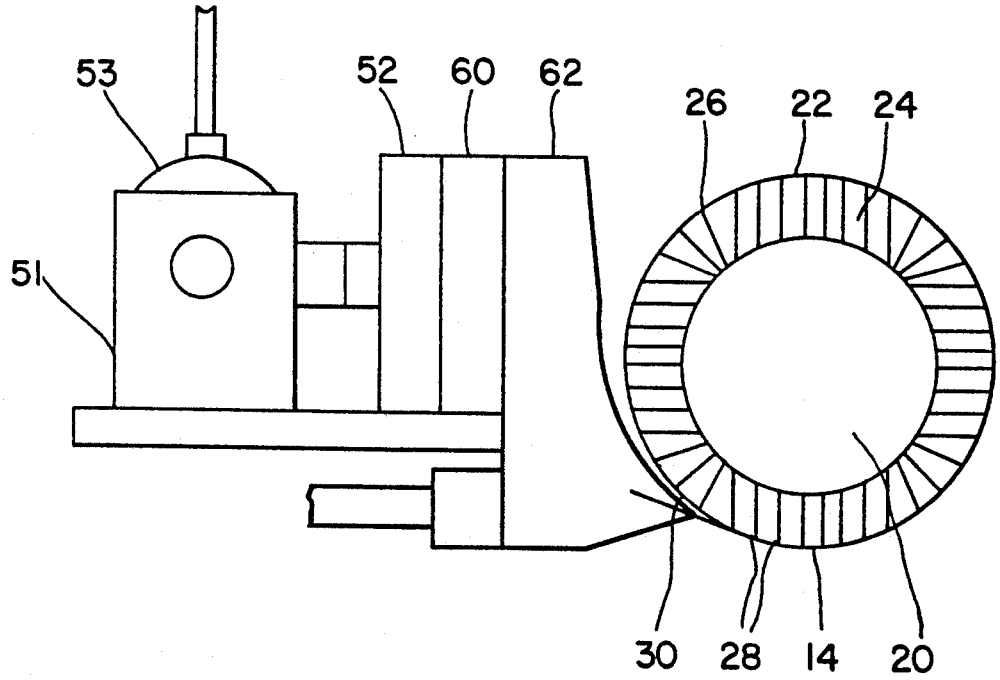
FIG. 3 is an elevational view of the inking system of the present invention.
Figure 4:
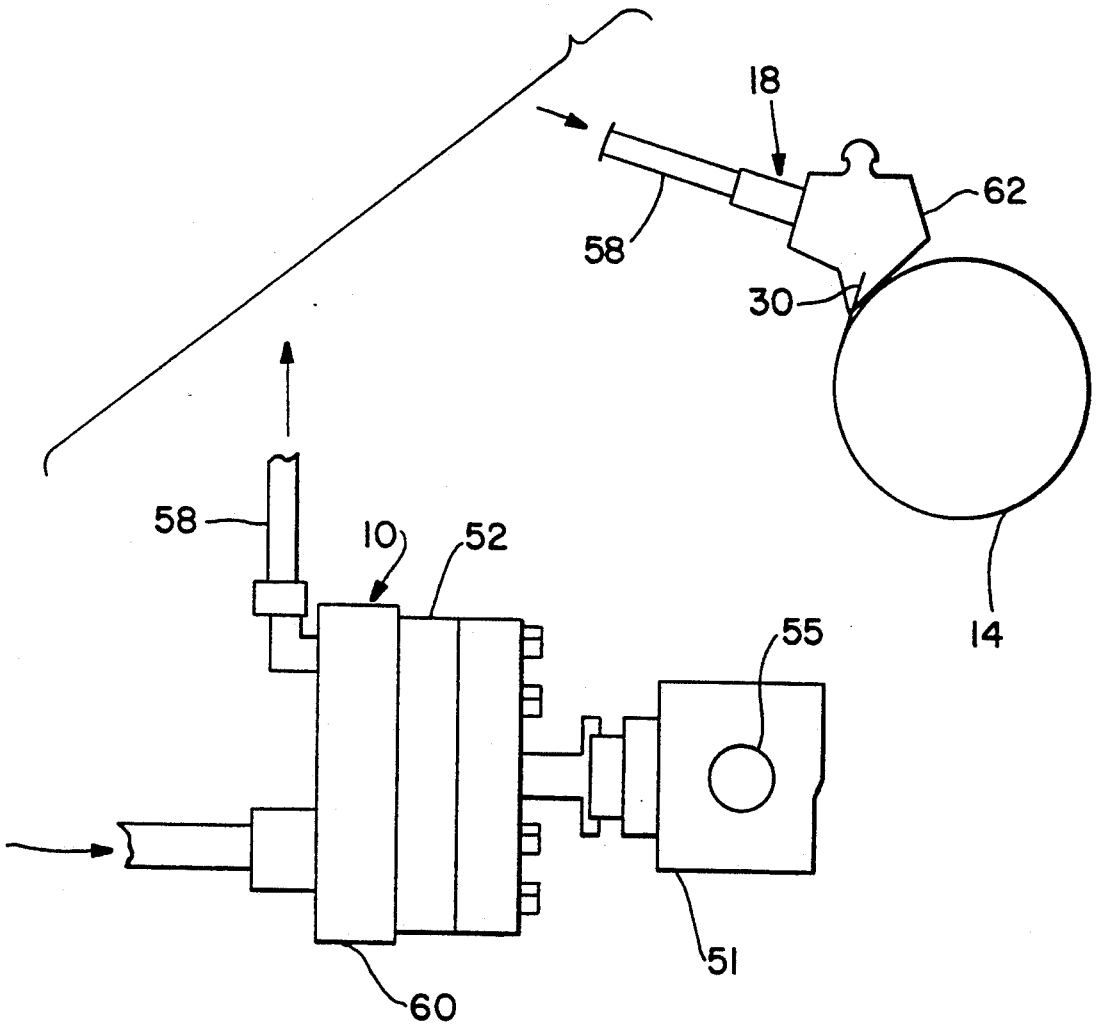
FIG. 4 is a side elevational view of the inking system of the present invention.

With reference to FIGS. 1-3, the brush roller or fountain roller 14 has an inner cylindrical roll or roller 20 and an outer blanket 22 which is placed on the inner roller 20 and secured in place by a suitable device, such as by pins or by a retaining bar. The blanket 22 of the fountain roll or roller has a brush 24 defining an outer brush surface 26. The blanket 22 has closely spaced fibers 28 defining the outer brush surface, and may be constructed from a suitable resilient material, such as nylon, a trademark of E. I. Dupont de Nemours. The brush roller or fountain roller receives ink from the ink injector, and passes the ink in a uniform manner to the pick up roll or roller 16. In this configuration, it is not necessary to precisely set the gap between the fountain roller 14 and pick up roller 16 due to the brush 24 of the blanket 22 for the fountain roller 14. As belt shown in FIG. 2, the inking system 10 has a lower smoothing or spreading blade 30 located downstream from the fountain roll 14 relative to the direction of rotation of the fountain roller 14, in this case counterclockwise, and the smoothing blade spreads the injected ink uniformly and continuously onto the blanket 24 of the fountain roller 14 in order to provide a uniform spread of ink on the outer brush surface 26 of the fountain roller 14. In turn, the pick up roll 16 receives the ink from the outer brush surface 26 for further use and processing in the printing press 12. The fountain roll K is driven by a motor at a speed proportional to the press speed. All other inking rolls are driven by the press.

Figure 9:
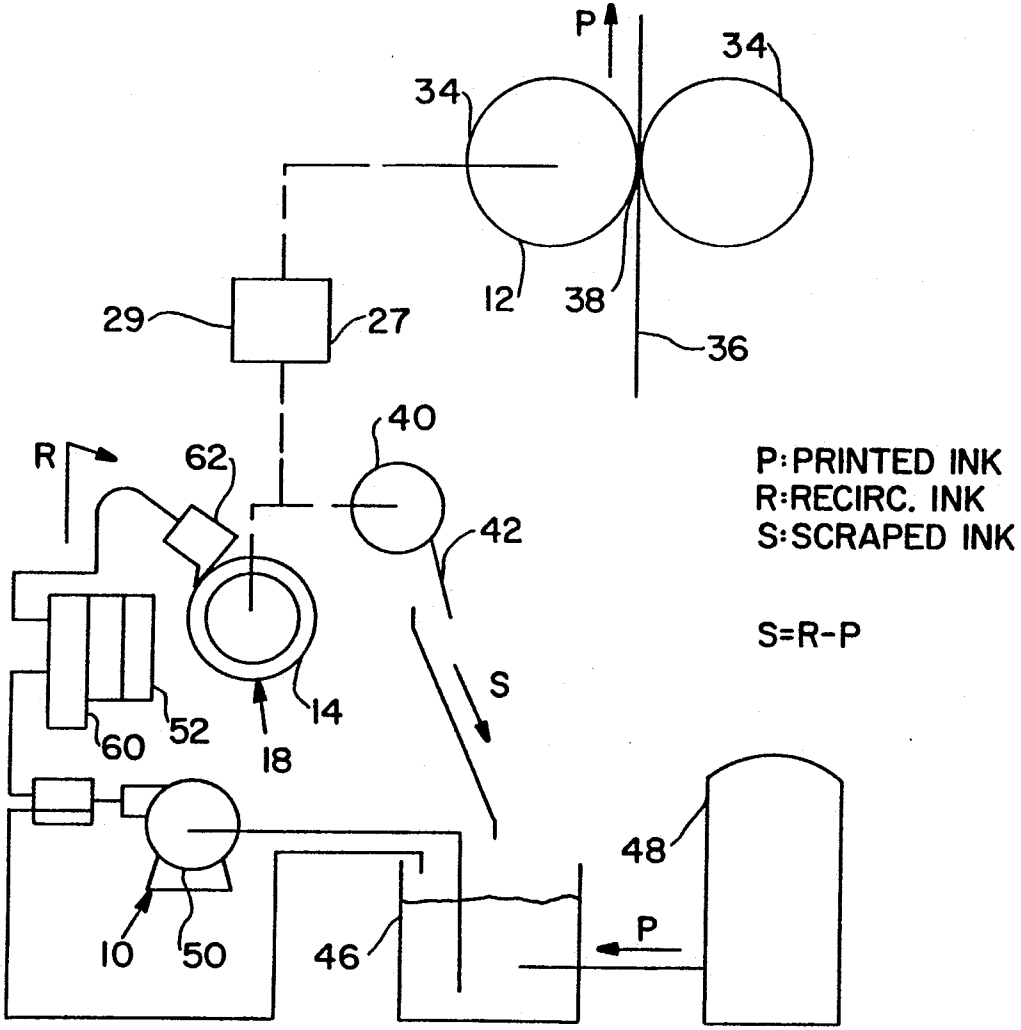
FIG. 9 is a diagrammatic view of the inking system of the present invention.

As shown in FIGS. 1 and 9, the printing press 12 has a plate cylinder 32 for retaining a suitable plate with image, and a pair of opposed blanket rollers 34 to receive ink in a pattern from the plate cylinder 32, and place the ink pattern onto a paper web 36 passing through a nip 38 between the blanket rollers 34.

The press 12 has a scraper roller 40, such as an oleophilic ceramic roller for durability or some other such roller, which is gear driven in the press 12. As shown, the inking system 10 has a scraper blade 42 for removing ink or an ink pattern from the outer surface of the scraper roller 40. In this manner, the scraper blade 42 cleans the scraper roller 40 in order to remove the residual image which may appear on the roll 40, and to clean the roller 40.

The ink scraped by the scraper blade 42 from the scraper roller 40 passes into an ink mix auger 44 which serves as a catch pan to receive the residual ink, and to allow a slow flow of the ink to aid in evaporation due to convection at this time, and then return the ink to an ink supply reservoir 46. The recirculated ink from the auger 44 is mixed with a fresh supply of ink from a pressurized ink tank 48, as best shown in FIG. 9. As shown in FIGS. 1 and 9, the inking system 10 has an ink supply pump 50 for pumping ink from the reservoir 46 through a pressure regulating valve into the inlet manifold of the ink metering pump 52. The bypass ink from the pressure regulating valve is returned to the ink tank 46.

Figure 5:
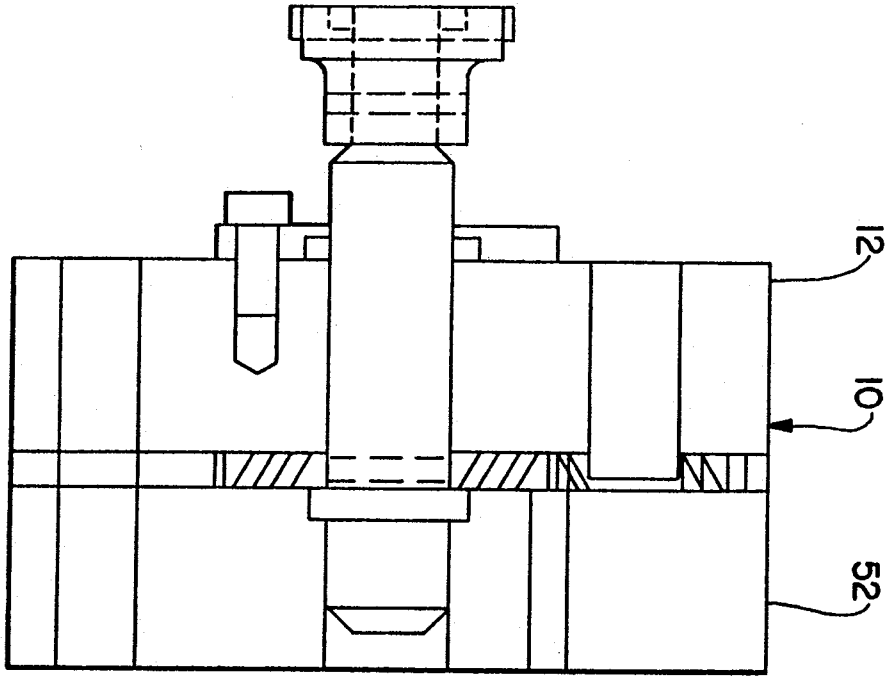
FIG. 5 is a sectional view of an injector pump for the inking system of the present invention.
Figure 6:
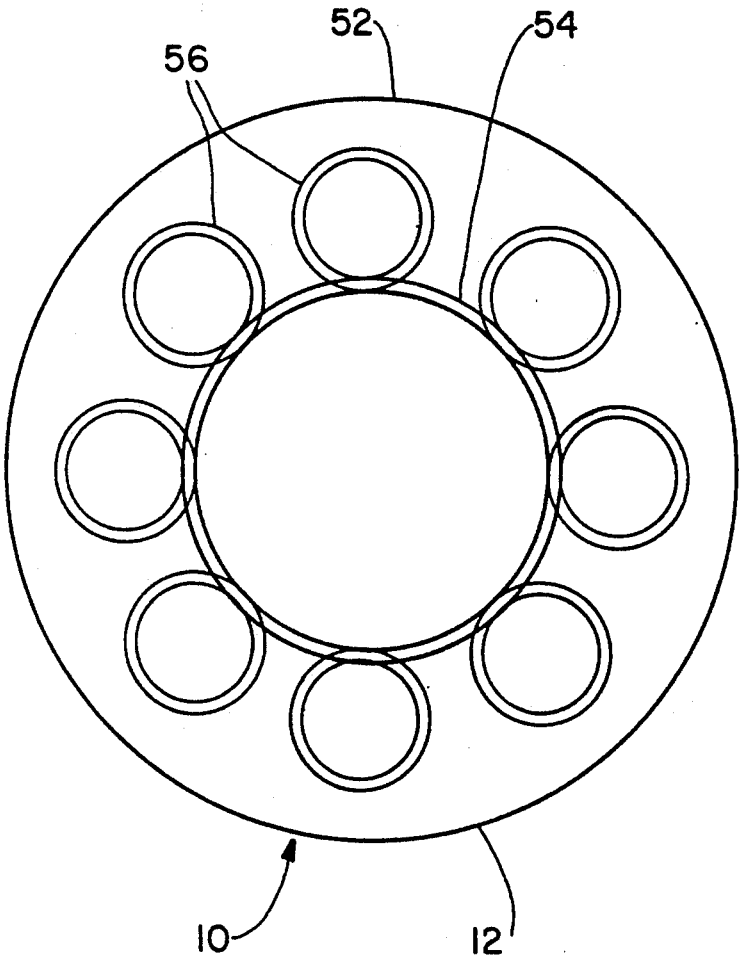
FIG. 6 is a plan view of an 8-stream planetary gear system for the pump of FIG. 5.
Figure 7:
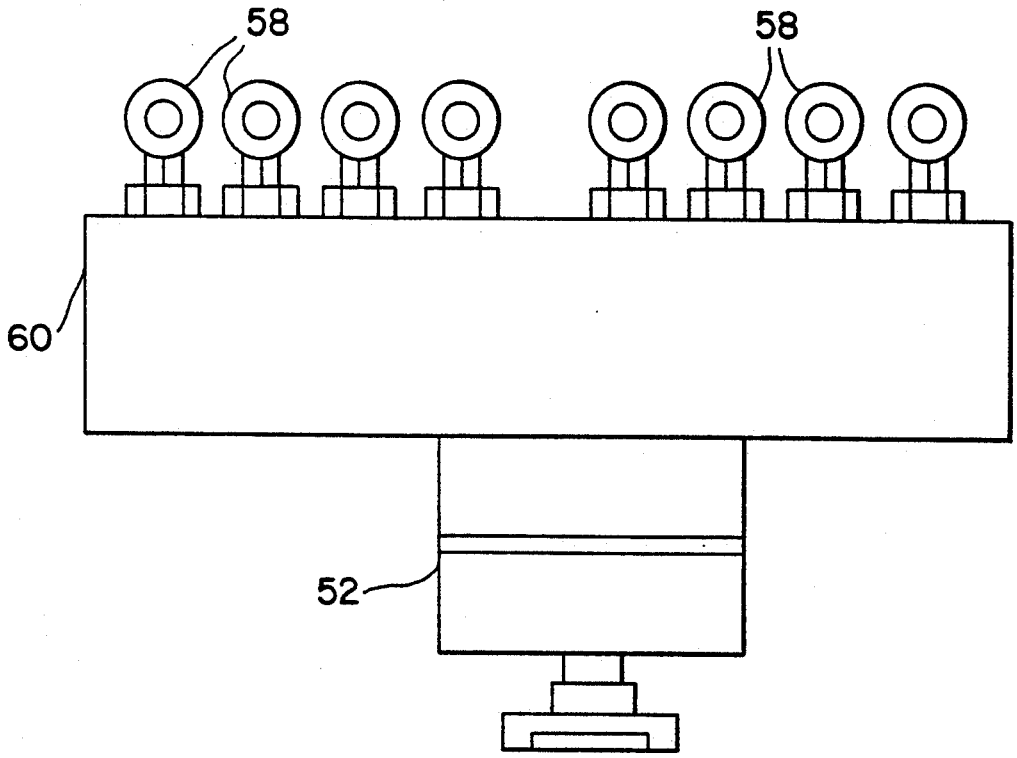
FIG. 7 is a top plan view of a pump system for the inking system of the present invention.
Figure 8:
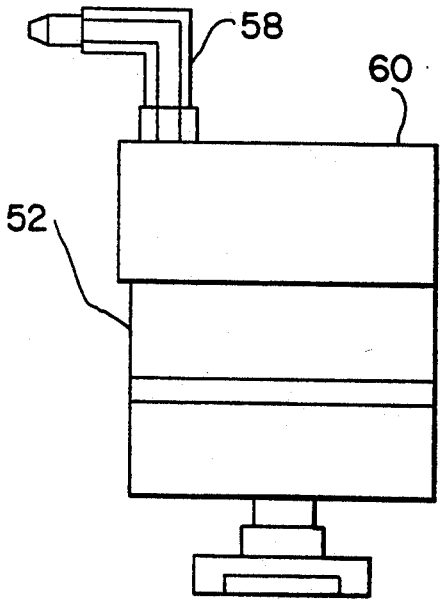
FIG. 8 is a side elevational view of the inking system of FIG. 7.

As shown in FIG. 3, the inking system 10 has a gear box 51 with a drive shaft 55, and a D.C. motor 53 associated with the gear box 51. The inking system 10 has an 8-stream planetary gear pump 52, as best shown in FIGS. 1, 5, and 6, with the pump 52 having an inner rotated gear 54, and a plurality of outer planetary gears 56 driven by the gear 54 in order to pump the supply of ink in a positive manner. The pump 52 supplies a controlled volume of ink into the ink train of the inking system 10 for the press 12.

The ink flow rate is proportional to the speed of the printing press 12, although the proportionality between the ink press speed and the flow of ink from pump 50 may be modified as desired for improved shade control of the inking system 10 of the present invention.

The ink from the pump 52 having the gears 54 and 56 are passed through a plurality of conduits 58, such as 8, communicating with a manifold 60 associated with the pump 52, as best shown in FIGS. 1, 3, 4, 7, and S. The ink from the conduits 58 pass to an ink distribution rail 62 where the ink is deposited in a uniform manner onto the brush roller or fountain roller 14, after which the pumped ink is smoothed by the smoothing blade 30, in a manner as previously described, in order to obtain an improved uniform distribution of ink on the outer brush surface 26 of the fountain roller 14 for supplying the ink to the pick up roll 16 and the remainder of the press 12.

Thus, in accordance with the present invention, the ink injector 18 provides a supply of metered ink under pressure by pumping the ink into the ink rail 62 and onto the fountain roller 14. The fountain roller 14 has a brush 24 on a blanket 22 in order to define an outer brush surface 26 for passage of the ink in a uniform manner to the pick up roll 16 without the necessity of carefully setting a gap between the fountain roller 14 and pick up roll 16, which was required in the past. In addition, the inking system 10 removes residual ink and possible ink patterns forming shadows from the scraper roller 40 by a scraper blade 42, where the ink is captured and recycled into the ink reservoir 46 also receiving a fresh ink supply from a tank or canister. In addition, separate portions of the inking system 10 may be replaced in a simplified manner in the event that a change is desired in colors for the press. Further, the metering of the ink by the ink injector 18 is formed directly proportional to the speed of the printing press 12, and may be modified as desired.

The system of the present invention provides for a quick color change. The module discussed above forms a self contained one page wide injector system, including the D.C. motor 53, which is quickly removable.

The foregoing detailed description has been given for clearness of understanding only, and no unnecessary limitations should be understood therefrom, as modifications will be obvious to those skilled in the art.

What is claimed is:

1. An inking system for a printing press, comprising:

an ink injector having means for supplying metered ink in an amount proportional to the printing press; and a fountain roller having an outer brush surface for receiving an distributing ink from the injector;

means for rotating the fountain roller in a specified rotational direction; and a spreading blade located adjacent and downstream from the injector relative to the fountain roller, and extending laterally along and in contact with the fountain roller, with said spreading blade extending at an angle to the fountain roller in a direction disposed along the direction of rotation of the fountain roller.

2. The system of claim 1 including means for changing the proportionality of metered ink relative to the press speed.

3. The system of claim 1 including a pick up roll located adjacent the fountain roller.

* * * * *